US005609457A

United States Patent [19]

Burns

[11] Patent Number: 5,609,457

[45] Date of Patent: Mar. 11, 1997

[54] PIPE ALIGNMENT APPARATUS FOR USE ON WELLHEAD DERRICK

[75] Inventor: Kenneth M. Burns, Calgary, Canada

[73] Assignee: Burns, Stevenson & Associates, Ltd., Calgary, Canada

[21] Appl. No.: 441,849

[22] Filed: May 16, 1995

[30] Foreign Application Priority Data

Jan. 13, 1995 [CA] Canada ..... 2140203

[51] Int. Cl.[6] ..... E21B 19/16

[52] U.S. Cl. ..... 414/22.51; 175/85

[58] Field of Search ..... 175/85; 294/104; 414/22.51, 22.61, 22.63

[56] References Cited

U.S. PATENT DOCUMENTS

| | | | |
|---|---|---|---|
| Re. 30,071 | 8/1979 | Hilding | 175/85 |
| 2,416,815 | 3/1947 | Calhoun | 414/22 |
| 2,450,934 | 10/1948 | Calhoun | 166/77.5 |
| 2,828,024 | 3/1958 | True . | |
| 3,061,011 | 10/1962 | Paget | 166/77.5 |
| 4,030,746 | 6/1977 | Langowski | 414/22.51 X |
| 4,274,777 | 6/1981 | Scaggs . | |
| 4,295,527 | 10/1981 | Rüsse | 166/380 |
| 4,304,433 | 12/1981 | Langowski | 294/106 |
| 4,440,536 | 4/1984 | Scaggs | 414/22.51 |
| 4,652,195 | 3/1987 | McArthur | 175/85 X |
| 4,681,158 | 7/1987 | Pennison | 166/77.5 |
| 5,127,790 | 7/1992 | Teague | 414/22.51 X |

FOREIGN PATENT DOCUMENTS

| | | | |
|---|---|---|---|
| 869411 | 4/1971 | Canada | 255/14 |
| 1167024 | 5/1984 | Canada | 255/14.2 |
| 1238574 | 6/1988 | Canada | 166/71 |

OTHER PUBLICATIONS

"Penniyoke Tubular Alignment Tool", Weatherford Tubular Services, ©1990.

*Primary Examiner*—David A. Bucci
*Assistant Examiner*—Janice L. Krizek
*Attorney, Agent, or Firm*—Jim Zegeer, Esquire

[57] ABSTRACT

An alignment apparatus for use on a well derrick or drilling rig for engagement with a pipe section either being connected to or disengaged from the upper end of pipe string within a well bore hole. The apparatus includes a supporting frame for connection to the framework of the derrick and carrying a head assembly for engaging an upper pipe section in a manner to align the pipe section with a pipe section within the bore hole and yet allowing rotation of the upper pipe section. The head assembly includes a fixed pipe engaging member and movable arms pivotable to a closed position, the pipe engaging member and the arms all having pipe engaging surfaces. Adjustment mechanisms are provided to accomplish positioning of the fixed pipe engaging member and the arms so that the pipe engaging surfaces of the member and the arms can be selected whereby the surfaces are each spaced from the aligned central axis of the pipe section a distance slightly greater than the radius of the outside diameter of the pipe when the arms are moved to a closed position. The apparatus is capable of quick and accurate alignment of pipe sections and may be readily adjusted to permit use with a variety of sizes of pipes.

18 Claims, 7 Drawing Sheets

PIPE ALIGNMENT APPARATUS FOR USE ON WELLHEAD DERRICK

FIELD OF THE INVENTION

This invention relates to a wellhead pipe alignment apparatus of a type which may be mounted on the frame of a well derrick or drilling rig for engagement with a pipe section either being connected to disconnected from the upper end of another pipe section within a well bore.

DESCRIPTION OF THE PRIOR ART

In the drilling and maintenance of wells it is necessary to install in the well, or remove from it, lengths of drill strings or casings which are formed by pipe sections joined together by threaded connectors. During the installation, for example, the upper end of the last section of pipe of the string is maintained slightly above the level of the work table positioned at the base of the derrick, and the next section is raised to a suspended position so that its lower end is located immediately above the upper end of the last section. The bottom end of the suspended section provides male threads to be turned into a collar having the female Ehreads at the upper end of the last section. Unless the suspended section is axially aligned with the upper end of the last section as it is engaged and turned to complete the screw connection between the two sections, cross threading occurs, and the damage caused can be sufficient to require the suspended section to be removed for repair, which, of course, is time consuming and expensive.

The most common practice used in aligning the suspended section is to locate a workman on a platform at a position high on the derrick adjacent the upper end of the suspended section so that as the lower end of the section is brought into engagement with the upper end of the last section, the workman manually manipulates the upper end of the suspended section whereby the sections are axially aligned. This practice is dangerous, particularly during unfavorable weather conditions, and time consuming so as to significantly increase the cost of the operation of installing or removing strings of tubular members from the well. Moreover, this approach does not always assure sufficiently accurate alignment to avoid the problems of cross threading.

While there have been developed a number of alignment devices, none have been sufficiently successful to be utilized to any extent in the oil fields. One major disadvantage appears to be that some of the known devices are of a complex nature and are thus expensive and difficult to install and operate. They are also cumbersome to transport under the conditions which frequently exist in oil fields. Others appear to provide unsatisfactory results either in accuracy or in their manner of mounting. Also, in drilling a well, after setting up the derrick, the drilling string is assembled and usually disassembled and reassembled a number of times, and then in subsequent testing and possibly establishing a well for pumping, pipes of a number of different sizes are handled by the crew at the derrick. Thus, the alignment device must be capable of accommodating the different sizes while, of course maintaining the longitudinal axis of the section of pipe being installed or removed coaxial with the next lower pipe section in the bore hole. It is important, therefore, that any adjusting of the device for pipe size be capable of being carried out accurately and quickly. In any event, the most common practice still is that of utilizing a person to manually align the suspended pipe sections rather than making use of a mechanical alignment apparatus which can be controlled from the area of the worktable.

SUMMARY OF THE INVENTION

It is an object of the present invention to provide an apparatus which can be controlled from a ground position for containing an upper portion of a pipe section and accurately retaining the pipe section in axial alignment with the pipe string in the bore hole.

It is a further object of the present invention to provide an alignment apparatus which is versatile in that it may be quickly adjusted for use with a number of different pipe sizes.

The well pipe alignment apparatus of the present invention is of the type for mounting on a derrick framework above a wellhead and is engagable with an upper pipe section having a screw connection at the lower end thereof for threading engagement with an upper end of a lower pipe section within a well bore. The apparatus includes a supporting frame having an outer end for connection to the derrick framework with a head assembly carried at an inner end of the supporting frame above the upper end of the lower pipe section. The head assembly has a base member with pipe engaging means for aligning a central longitudinal axis of the upper pipe section with the line of axis of the lower pipe section and allowing rotation of the pipe section with the head.

According to one aspect of the invention the pipe engaging means includes a fixed pipe engaging guide member and a movable arm means pivotable between an open position and a closed position. The fixed guide member and the arm means together have at least three pipe engaging surfaces for engaging a pipe of a particular outer diameter at spaced points about more than 180° of the pipe circumference. Power actuating means are provided for moving the arm means between the open and closed positions. Stop means are selectively adjustable between a plurality of positions for determining the position of the pipe engaging surface of the arm means relative to the pipe engaging surface of the fixed guide means for thereby selectively accommodating pipes of a plurality of different diameters.

According to another aspect of the present invention, the pipe engaging means includes a pipe engaging guide means and arm means movable between an open position and a closed position with power actuating means for moving the arm means between the open and closed positions. The pipe engaging guide means together with the arm means in the closed position provide at least three pipe engaging surfaces for engaging a pipe of a particular outer diameter at spaced points about more than 180° of the pipe circumference. A first adjustment means is provided for permitting movement of the pipe engaging guide member relative to the head assembly toward and away from the central longitudinal axis of the upper pipe section, and including lock means for securing the fixed pipe in a position selected to accommodate a specific pipe size. A second adjustment means is selectively movable to a position for determining the position of the pipe engaging surfaces of the arm means in the closed position in accordance with the selected pipe size.

BRIEF DESCRIPTION OF THE DRAWINGS

In the accompanying drawings, which show an embodiment of the invention by way of example.

DESCRIPTION OF PREFERRED EMBODIMENTS OF THE INVENTION

Figure 1:
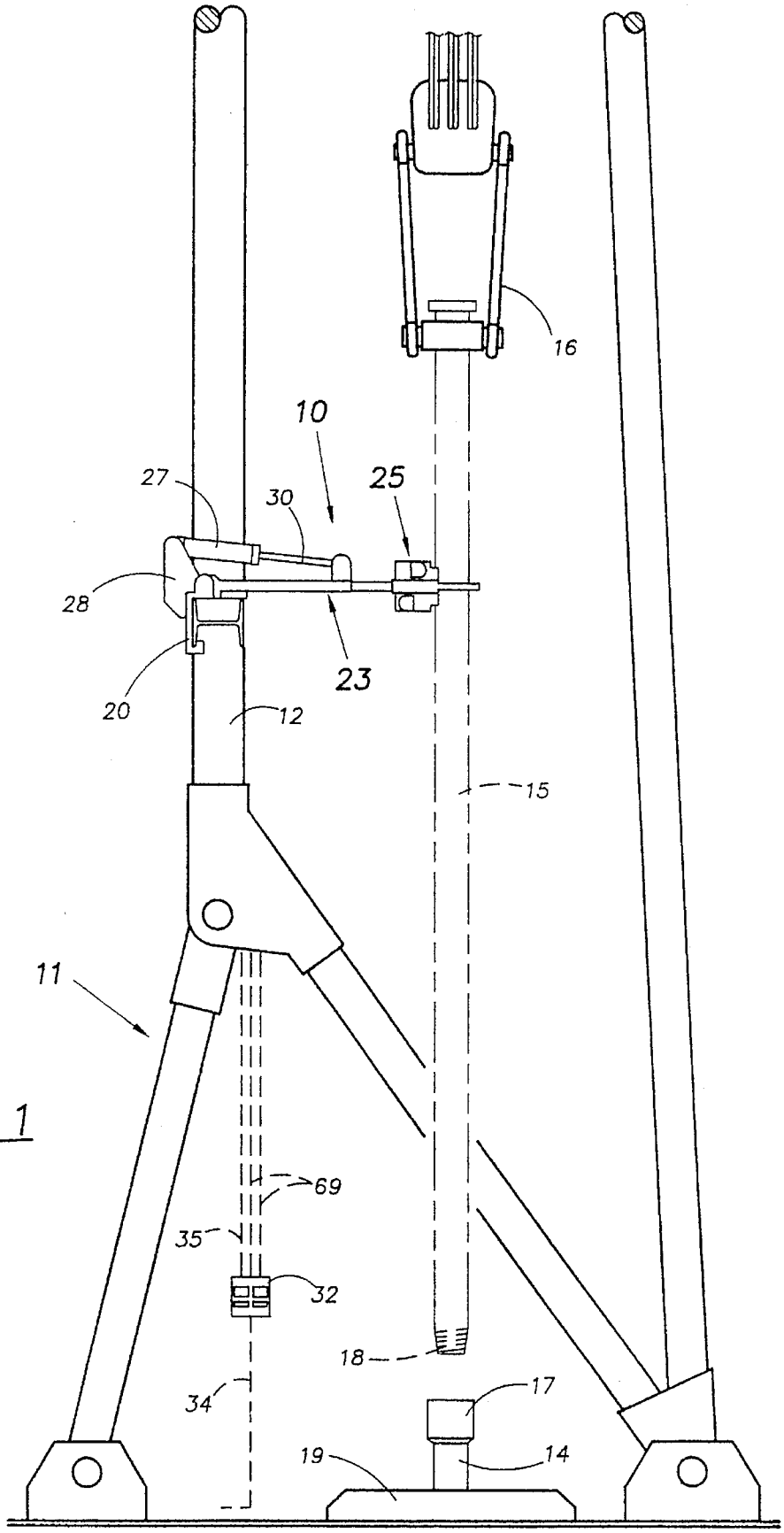
FIG. 1 is an elevational view of the bottom portion of a derrick on which the pipe aligning apparatus of the present invention is mounted.

In the drawings, which have reference characters denoting elements corresponding to those described hereinafter, the reference character 10 generally denotes the well pipe alignment apparatus of the present invention, and in FIGS. 1 and 2, the apparatus 10 is shown as being mounted on a framework 12 of a derrick or oil well rig 11. The derrick 11 is stationed on the ground above a well bore (not shown) into which a lower pipe section 14, which may actually be the top pipe section of a string consisting of a plurality of pipe sections threadingly joined end-to end, has been sunk into the bore. An upper pipe section 15 is shown as having been raised by a block system 16 to a suspended position above the lower pipe section 14. The lower pipe section 14 has an internally threaded collar portion or female part 17 at its upper end disposed above the worktable 19. The lower end or male portion 18 of the upper pipe section is externally threaded so that after alignment and being slightly lowered, the upper section 15 may be turned to thread the threaded male portion 18 of the upper section into the threaded female part 17 of the lower pipe section so as to join the two sections together. It should be noted that while reference is broadly made to pipe sections 14 and 15, which would normally be of identical structure in forming a continuous string, the term pipe section is meant to denote either sections to form a bore hole casing, a drill pipe, a pumping casing, or any other cylindrical members which may be threaded together and lowered into a bore hole.

Figure 2:
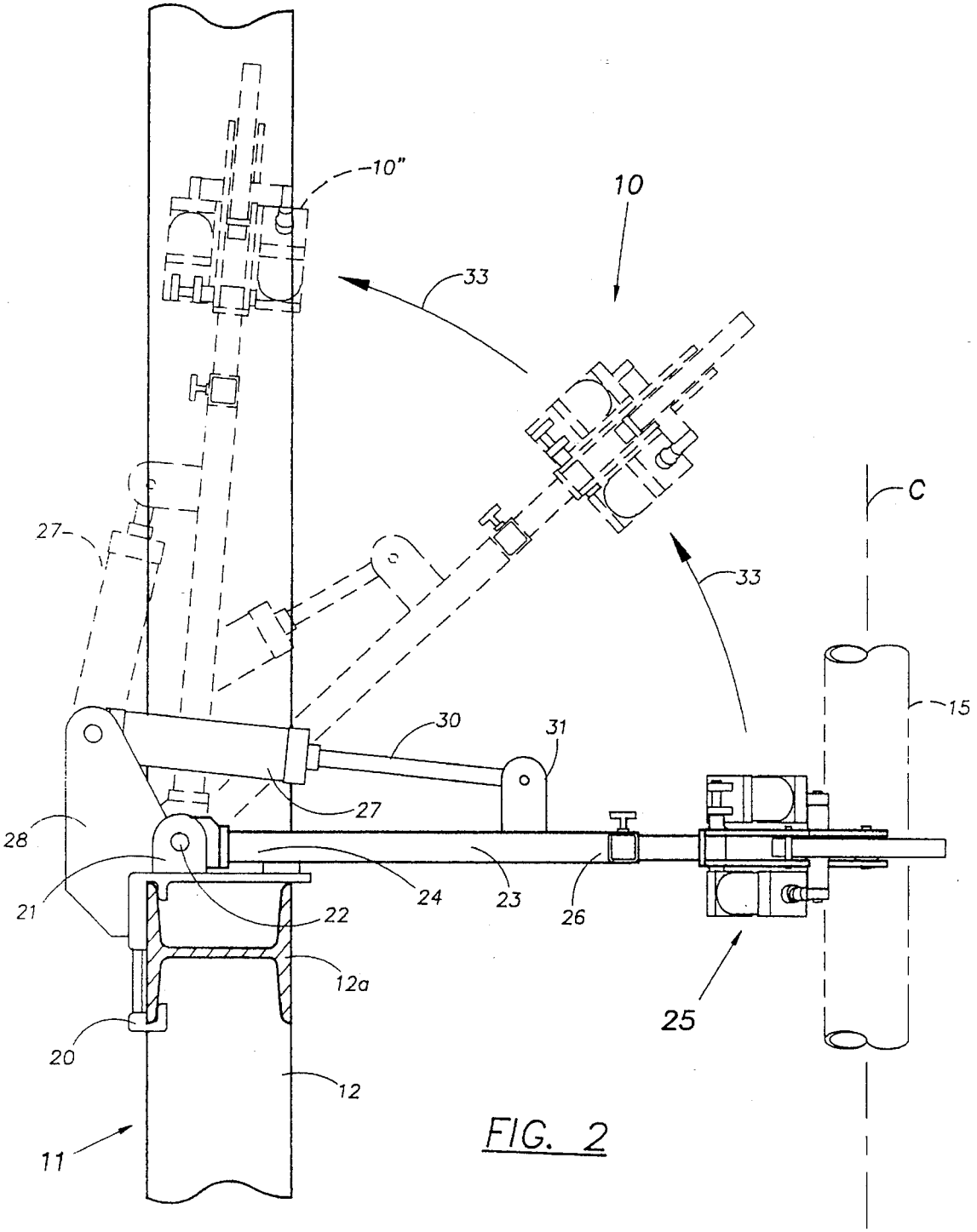
FIG. 2 is a side view of the apparatus shown in Figure but on an enlarged scale and also showing the apparatus in different operational positions in relation to the section of pipe.

Turning now to FIG. 2, the alignment apparatus 10 includes a mounting bracket or structure 20 for clamping the apparatus to a horizontal or transverse member 12a of the framework 12 in the derrick 11, the mounting structure including lugs 21 carrying pins 22 on which an outer end 24 of a supporting frame 23 of the alignment apparatus 10 is mounted so as to allow the frame member and the head assembly 25, which is carried on an inner end 26 of the frame member 23, to pivot about an axis A (FIG. 3) from an operative position to a retracted non-operative position. The alignment apparatus 10 is mounted on the derrick framework 12 at a position above the work area so that in relation to the length of the pipe section 15, the head assembly in its operative position engages the pipe section 15 adjacent its upper end.

In the embodiment shown, the frame member 23 is in a substantially horizontal position when in the active position, and when it is in the fully retracted position 10" (FIG. 2), it is raised to a substantially vertical position and disposed between vertical members of the derrick framework 12 so as to be less subject to damage during the raising and lowering of each pipe section 15. It is apparent, of course, that alternatively, in order to retract the alignment apparatus to a non-operative position, the frame could be allowed to swing downwardly so as to hang in a substantially vertical position. In the illustrated embodiment of FIG. 2, however, the frame is held in the substantially horizontal operative position by a pneumatic cylinder 27 which is pivotally connected at its base to a lug 28 which is affixed to the mounting bracket. The outer end of a piston rod 30 of the pneumatic cylinder 27 is pivotally connected to a lug 31 which is affixed to the supporting frame 23 of the pipe alignment apparatus at a location adjacent the inner end of the frame 23.

When the piston rod 30 is fully extended, the frame 23 is supported in its generally horizontal position with the head assembly 25 positioned over the well bore hole. As controls 32 (FIG. 1) are activated to supply pressurized fluid to the piston rod end of the cylinder so as to force retraction of the piston rod 30, the frame 23 is pulled upward as indicated by arrows 33 (FIG. 2) to a retracted or raised position 10'. The controls 32 are preferably positioned in an area adjacent the worktable 19, and in the case where the means for raising the alignment apparatus to a retracted position is a pneumatic cylinder, as indicated above, the controls 32 may include a valve system which is connected to a source air line 34. The valve system when appropriately maneuvered places air line 34 which communicates with a pressurized air source (not shown) to a line 35 which extends to the pneumatic cylinder 27. Alternatively, the controls at ground level may be electrical for providing signals to activate a solenoid activated valve located at the level of the alignment apparatus.

Figure 3:
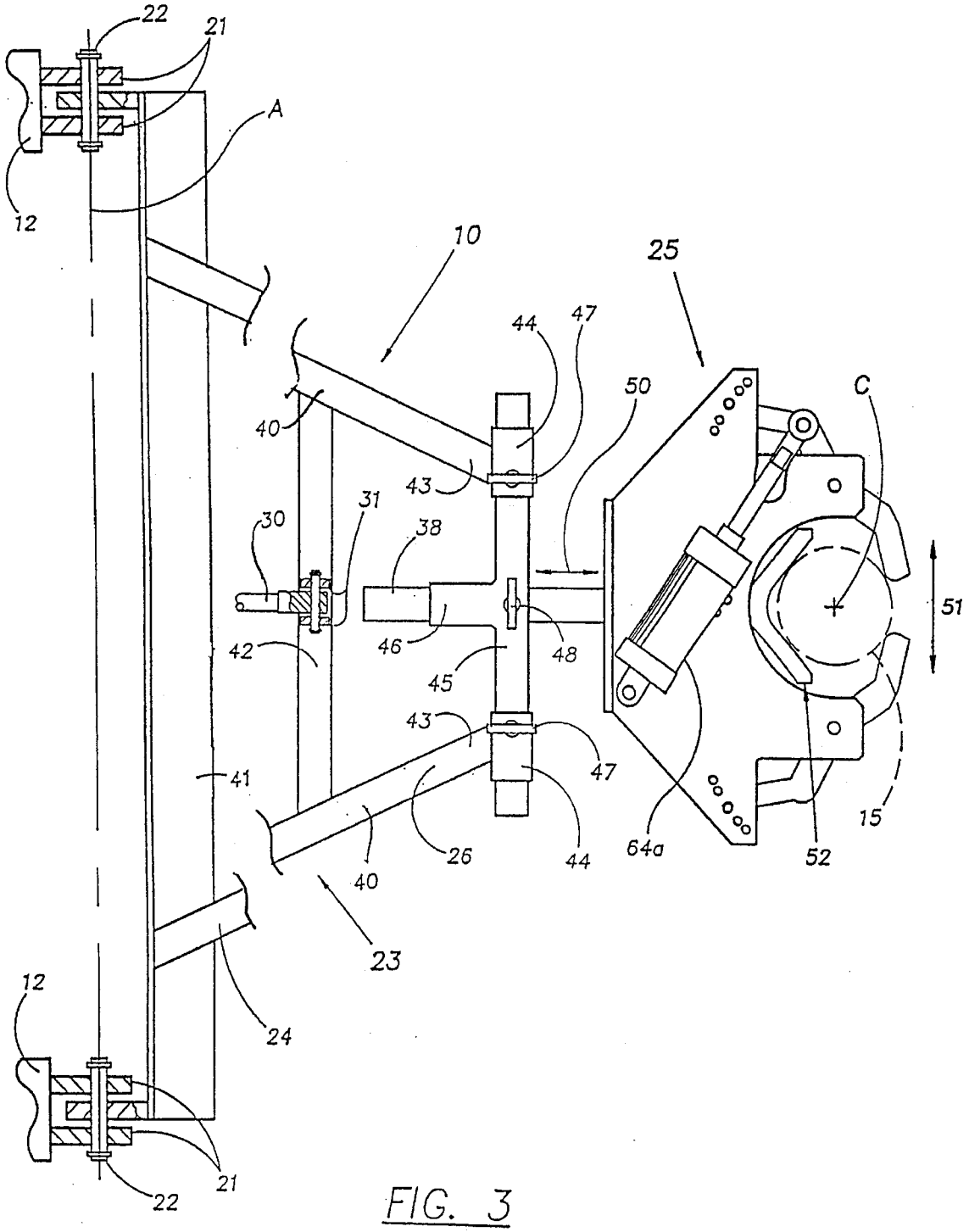
FIG. 3 is a plan view of the alignment apparatus of the present invention in a lowered operative position.

The head assembly 25 includes a base member formed primarily by a pair of parallel, horizontal upper and lower flat base plates 36*a*, 36*b* (FIG. 4) which are spaced and affixed, such as by welding to a vertical plate 37. The vertical plate 37 is affixed to a shank 38. The purpose of the alignment apparatus 10 is to hold the upper end of the pipe section 15 so that its centre is directly above the centre of the next lower pipe section 14. Thus, it is necessary prior to commencing the installation of the pipe section 15 to ensure that the head assembly is above the centre of the worktable 19. The centering operation is accomplished by adjusting the head assembly 25 relative to the frame member 23 by way of a set-up means. As shown in FIG. 3, the inner end 26 of the frame 23 includes a pair of spaced frame members 40,40 which are connected at their outer ends 24 by a transverse member 41, which in turn is pivotally connected to the framework of the derrick by pins 22 as previously described. The members 40,40 converge inwardly and are joined near the inner end 26 by a transverse brace member 42. At the free ends 43,43 of members 40,40 there are provided a pair of aligned sleeves 44,44 which telescopically receive a cross shaft 45. Thus the cross shaft 45 can slide longitudinally in the sleeves 44,44. The cross shaft 45 in turn has a sleeve 46 which is perpendicular to the axis of the aligned sleeve 44,44 and telescopically receives the shank 38 of the head assembly 25. The sleeves 44,44 each have a winged locking screw 47 associated therewith for engagement with the cross shaft to prevent movement of the cross shaft in the sleeves. The sleeve 46 also has a winged locking screw 48 associated therewith for engagement with shank 38 to prevent lengthwise movement of the shank through sleeve 46. By loosening screw 48, the shank 38 may be moved in either direction so as to allow adjustment of the head assembly 25 as indicated by the arrow 50. When the desired location is established in this direction, the screw 48 is again tightened. Thus, having achieved the adjustment of the centre of the head assembly in the to and fro direction 50 to correspond to the desired centre C of the pipe section, the winged locking screws 47,47 can be released to allow lengthwise sliding of the cross shaft 45. This permits the adjustment of the head assembly in the side-to-side direction indicated by the arrow 51. Having thus finalized the adjustment of the exact positioning of the head assembly, the screws 47,47 are again tightened and the apparatus is set up for the operation of aligning the pipe section 15 as described above.

Figure 5:
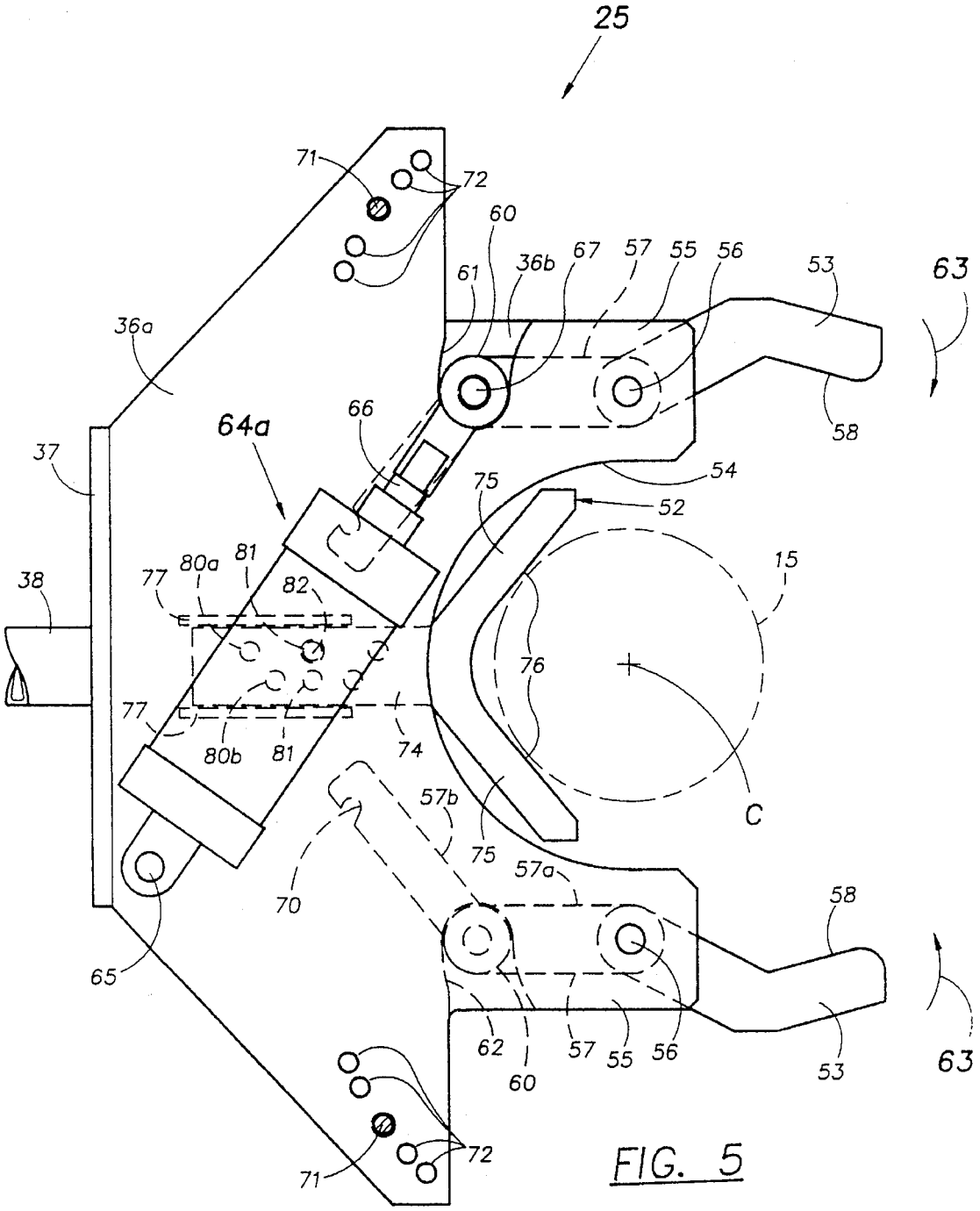
FIG. 5 is a top view of the head assembly of FIG. 4, showing the head assembly in an open, Pipe reception condition.
Figure 6:
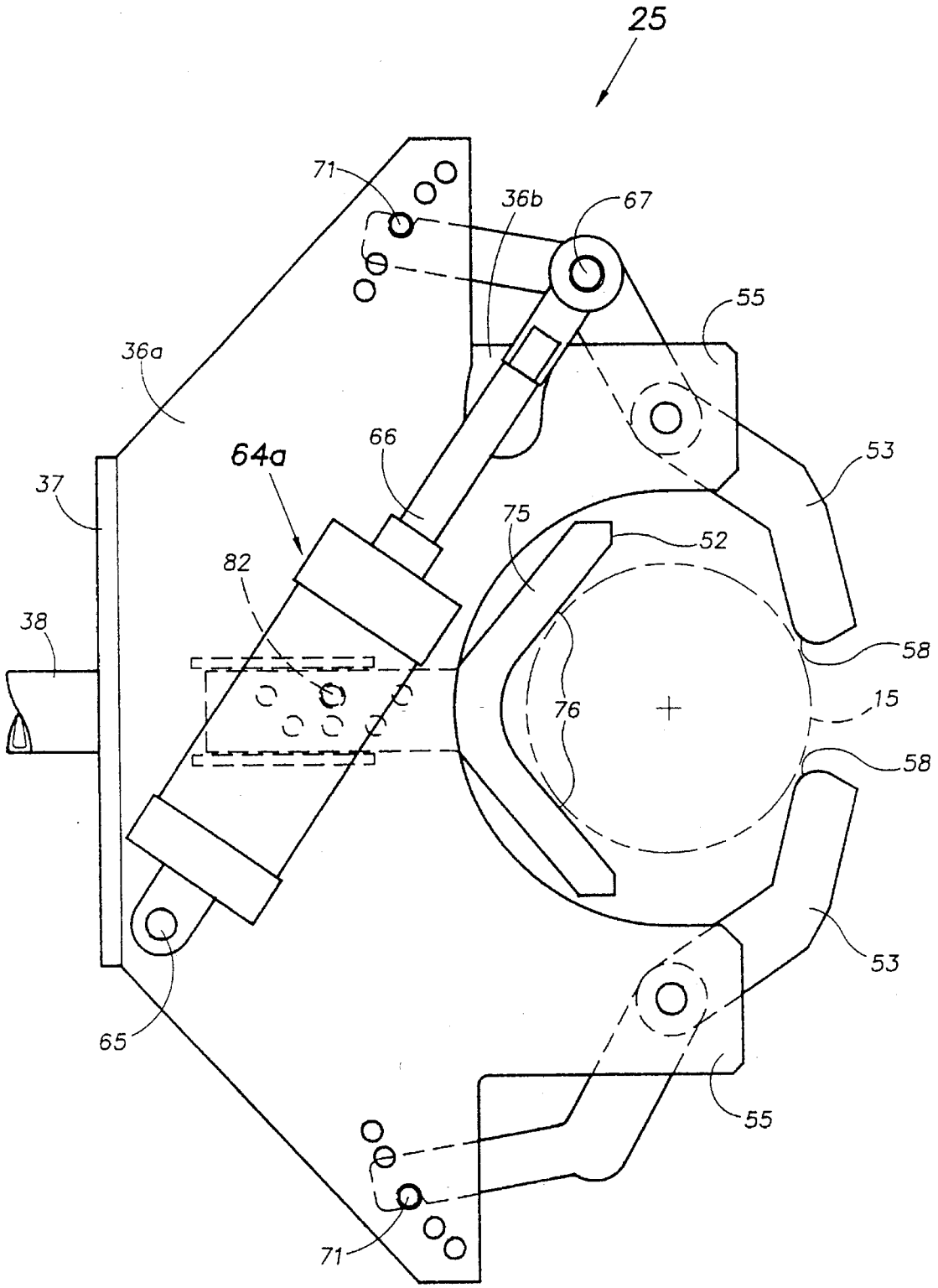
FIG. 6 is a view similar to FIG. 5, but showing the head assembly in a closed, pipe encompassing condition.

The head assembly 25 has mounted thereon pipe engaging means which include a fixed pipe engaging guide member 52 and a pair of movable arms 53,53. Looking at FIG. 5 wherein the upper horizontal base plate 36*a* is fully in view, it can be seen that this base plate is provided with a substantially semi-circular concave pipe receiving cavity or opening 54 which is of a radius somewhat greater than the radius of the largest pipe section to be handled by the pipe alignment apparatus. The lower base plate 36*b* has a like opening aligned with the opening of upper base plate 36*a*. Such openings are straddled by ear portions 55,55 of each base plate. Vertical pivot pins 56,56 each extend between the aligned ears of the two base plates to provide an individual pivotal mounting for each arm 53. The arms 53,53 have outer pipe engaging portions which have pipe engaging surfaces 58 extending along an inner edge thereof, and the arms include an inner portion which is integral with the outer portions but extend at an obtuse angle relative to the outer portions. Each arm 53 further has a tail or lever 57 which may be formed integrally with the inner portion of the arm. The lever portion 57 extends at an angle relative to the arm on the opposite side of pivot pin 56 and consists of two portions, a first portion 57*a* which has a post 60 attached to the end thereof opposite to the arm. The post 60 extends perpendicular to the upper side of the lever portion 57*a* for the arm shown, for example, at the top of FIG. 5. The post 60 for the other lever 57 (shown at the bottom of FIG. 5) extends perpendicular to the lower side of the lever portion 57*a*. The posts are of sufficient height to extend beyond the outside surface of the upper and lower base plates 36,36. The upper base plate has a notch 61 and the lower base plate has a notch 62, so that as the arms pivot in the direction of arrows 63 (FIG. 5), the posts are free to swing outwardly free of the base plates (FIG. 6).

Figure 4:
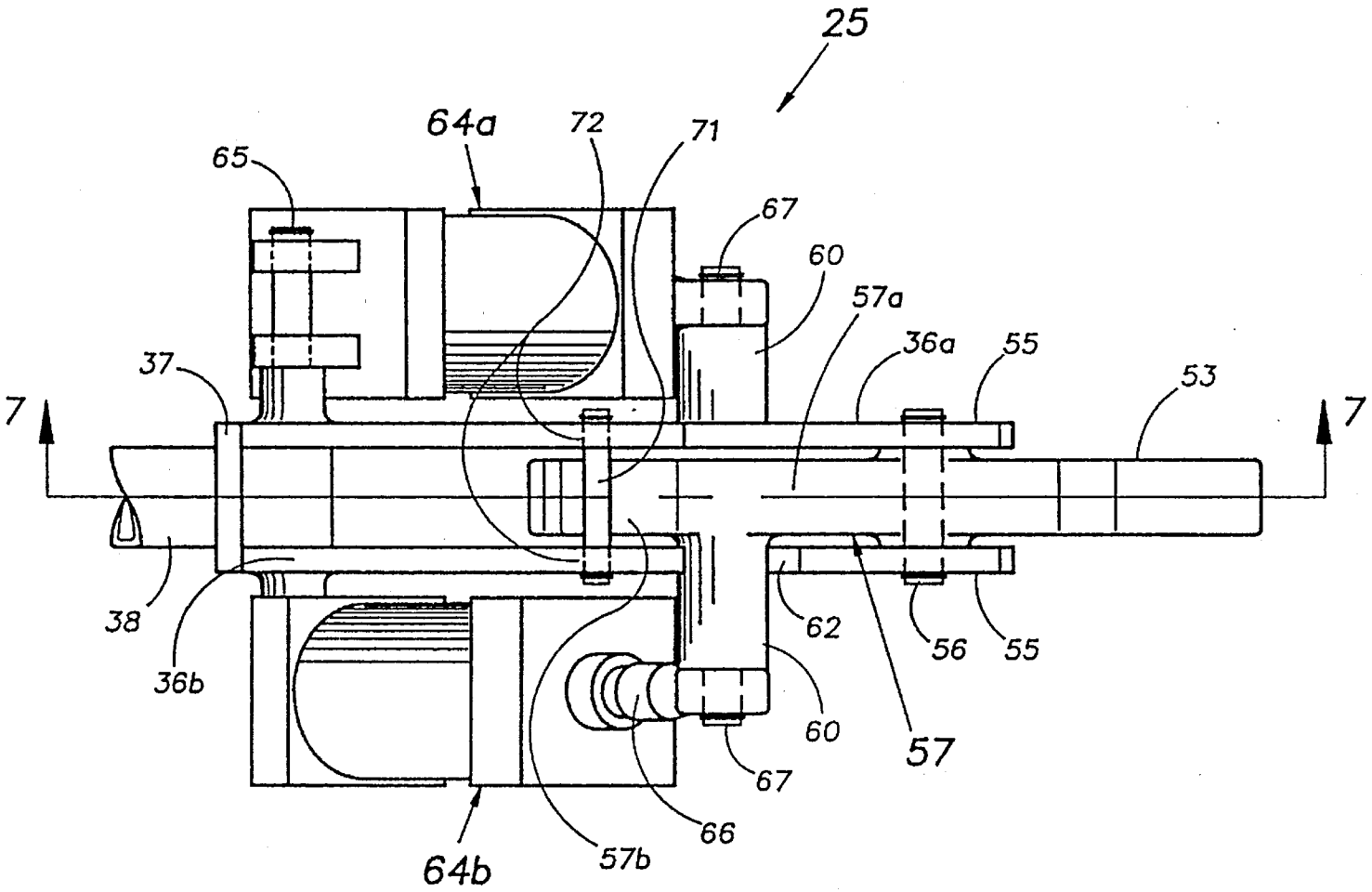
FIG. 4 is a side view of the head assembly of the alignment apparatus of the present invention.

Upper cylinder means 64*a* and lower cylinder means 64*b* are mounted above and below the base plates 36*a* and 36*b*, respectively (FIG. 4). The base ends of the upper and lower cylinder means 64*a*; 64*b* are pivotally attached to the outside surfaces of base plates by pivot pins 65, and the cylinder means each have a piston rod 66, the outer ends of which are pivotally connected one each to the posts 60 of the levers 57 by way of pivot pins 67 at the outer ends of the posts 60. The cylinder means 64*a*, 64*b* are preferably identical pneumatic cylinders which are connected in parallel to air lines 69 (FIG. 1), the lines being connected to opposite ends of each cylinder so that as air is admitted simultaneously to the base ends of both cylinders the piston rods 66 are forced to the extended positions to swing the arms 53, 53 from open position shown in FIG. 5, in the direction of the arrow 63, and eventually to the closed position shown in FIG. 6. Conversely, when the arms 53,53 are in the closed position of FIG. 6 and air is admitted to the other of the air lines 69, which is connected to the rod ends of the cylinder, the arms are forced to the open position (FIG. 5). The activation of cylinders means 64*a*, 64*b* may thus be controlled by an operator from the controls 32 adjacent the turntable.

A second portion 57*b* of each lever 57 is an integral portion of the lever which is shown as extending at an angle to an end of the first portion beyond the post 60. The second portion 57*b* functions as a stop engaging means for controlling the closed position of the arm 53. The stop means determines the outwardly projecting limit of the piston rod 66 when the controls 32 have been activated to extend the piston rod and thus close the arms 53,53. The lever portion 57*b* has adjacent its outer or free end the stop engaging means in the form of a stop engaging surface 70 shown as an arcuate shaped notch which engages a stop pin 71. The upper and lower base plates 36*a*, 36*b* are each provided with two series of bores or openings 72. Each series of openings 72 in one base plate is aligned with a like series of openings in the other base plate so that the stop pin may be selectively positioned in a pair of aligned openings and thus extend between the base plates and be in a position to engage within the notch 70 of the lever portion 57*b* as the piston rods move to the extended position. The array or series of each set of aligned openings presents the openings arranged on an arc struck on a radius about the axis of the pivot pin 56 for its respective arm so that regardless of the particular pair of openings 72 in which the stop pin for that particular arm is located the notch will swing to a position in which the pin 71 is received within the notch 70 forming the stop engaging surface.

The fixed pipe guide member 52 is of a substantially Y-shaped configuration consisting of a shank or base portion 74 and a pair of diverging leg portions 75. The inside of the diverging leg portions form pipe engaging surfaces 76,76 extending therealong. While the member 52 has been termed a fixed pipe guide member, its position is in fact variable depending on the outside diameter of the pipe being installed or removed from the bore hole, but unlike the arms 53,53, it does not move during the pipe enclosing or pipe releasing operations which are achieved by the actuation of the cylinder means 64*a*, 64*b*. The shank or base portion 74 which has straight sides is confined between a pair of parallel vertical guide plates 77,77 which are secured between the inside surfaces of the upper and lower base plates 36*a*,36*b*. The guide plates 77,77 form a channel, the longitudinal axis of which is perpendicular to the axis of pivot A of the supporting frame 23 and passes through the centre C of the pipe section 15 when the head assembly has been adjusted properly in the direction of arrow 51 (FIG. 3). The fixed pipe guide member, which is slidably received in the channel between the guide plates 77,77, is thus movable along the longitudinal axis of the channel toward and away from the centre C of the pipe section. Means are provided for allowing adjustment of the fixed guide member 52 to a number of positions and for locking the member 52 in a selected position. Such means are shown as consisting of two rows of openings or bores 80*a*,80*b* in the shank 74, the rows being parallel and spaced on opposite sides of the longitudinal centre line thereof. There are shown three bores in one row and two in the other, i.e. five in total, and the holes in the two rows are not transversely disposed opposite each other but are staggered. The upper and lower base plates 36*a*, 36*b* have a pair of transversely spaced aligned holes 81 for one each aligning with the holes in one of the rows of holes 80*a*, 80*b*. A pin 82 is provided for reception in one of the holes of the pair 81 and to pass through a hole in one of the rows of holes 80*a*, 80*b*, depending on the position of the guide member 52 along its axis of adjustment toward or away from the pipe section 15.

In operation, the supporting frame 23 is mounted on the derrick 11 in a position as previously described by way of the mounting bracket 20. The head assembly is installed and initially centered over the centre of the worktable by making the adjustment in the side-to-side direction and the to and fro directions, each followed by the locking of the screws 47,47 and the screw 48, respectively, as described above. Depending on the pipe size being installed, such as the tubular sections forming the drill rod, for example, adjustments are made to the means which establish the fixed position of the guide member 52, and the means which establish the position of the pipe engaging surfaces of arms 53,53 when the arms are in their fully closed position for the particular pipe in question. This may be readily done if, for example, the positioning of the holes of the series of holes 72 for determining the closed position of the arms 53,53 and the positioning of the holes in the rows of holes 81 in the shank 74 of the fixed guide 52, are arranged in a manner such that the holes are represented as providing the location of the surfaces 58 of the arms and 76 of the fixed guide 52 for properly encompassing a particular pipe size. For example, as shown in FIG. 5, the selection of the position of pin 71 and of the position of the pin 82 represents the positioning of the appropriate closed position of the arms 53,53, and the fixed position of the guide member 52 to encompass a mid sized tubular member commonly used in well drilling, casing testing pumping pipes, etc. The holes could in fact be marked to indicate the positioning of the pins in the pair of holes 72 and the hole 80*a* or 80*b* for accommodating a specific size of pipe.

It will be clear that when the arms 53,53 are moved to their maximum closed position as determined by the setting of the pins 71 for each arm, and wherein the position of the guide 52 has already been fixed by the positioning of pin 82, the point of contact at the surfaces 58 of the pipe engaging surface of the arm 53,53 and the point of contact of the pipe engaging surfaces 76 of the guide member will be located at a radius from the centre of the pipe section 15 approximately equal to the radius of the outside diameter of the pipe member being installed. Because the pipe section 15 must be turned, however, so as to thread its lower end into the next lower pipe section 14, a slight clearance must be allowed as shown in FIG. 6. Also, in view of the shape of the arms and the guide member the point of normal contact provided by the pipe surfaces 76 and 58 will vary along the surfaces depending on the pipe size in question. While it is preferable to utilize a pair of arms as shown in the illustrated embodiment, it would be possible to use a single arm, provided that together with the pipe guide member, the guide surfaces are arranged to provide at least three points of nominal contact spaced in total more than 180 about the circumference of the pipe so that the pipe is captured within the points of contact to thereby be held in alignment with the pipe section below it.

During installation of a pipe section, controls 32 are operated by a crew member so as to activate cylinders 27 to move the head assembly to its retracted position 10" (FIG. 2), this normally being done once a pipe section 15 has been attached to the pipe section already in the bore hole. The pipe string is then lowered and the next pipe section to be attached is raised into position by the block system 16. The controls 32 are then operated to lower the supporting frame 23, and thus the head assembly, into its operating position, during which time the arms 53,53 are in their open position (FIG. 5). As the head assembly approaches its operating position the pipe section 15 enters the opening 54 of the head assembly, or it is pulled into the opening by the closing of the arms 53,53 which is initiated by way of controls 32. The pipe section once held in the aligned position is rotated so as to thread the threaded lower end 18 into the threaded collar portion 17 of the pipe section 14. This having been completed the controls 32 are operated to initiate the opening of the arms by the retraction of the piston rods 66 of the cylinder means 64*a*, 64*b*, and the head assembly is moved to its raised or retracted position by the simultaneous activation of the cylinder 27.

It can be readily appreciated from the above that the alignment apparatus of this invention includes a head assembly which allows for the accurate alignment of a pipe section in a well head operation and allows for quick and accurate adjustment of the head assembly to accommodate pipes of various sizes.

Figure 7:
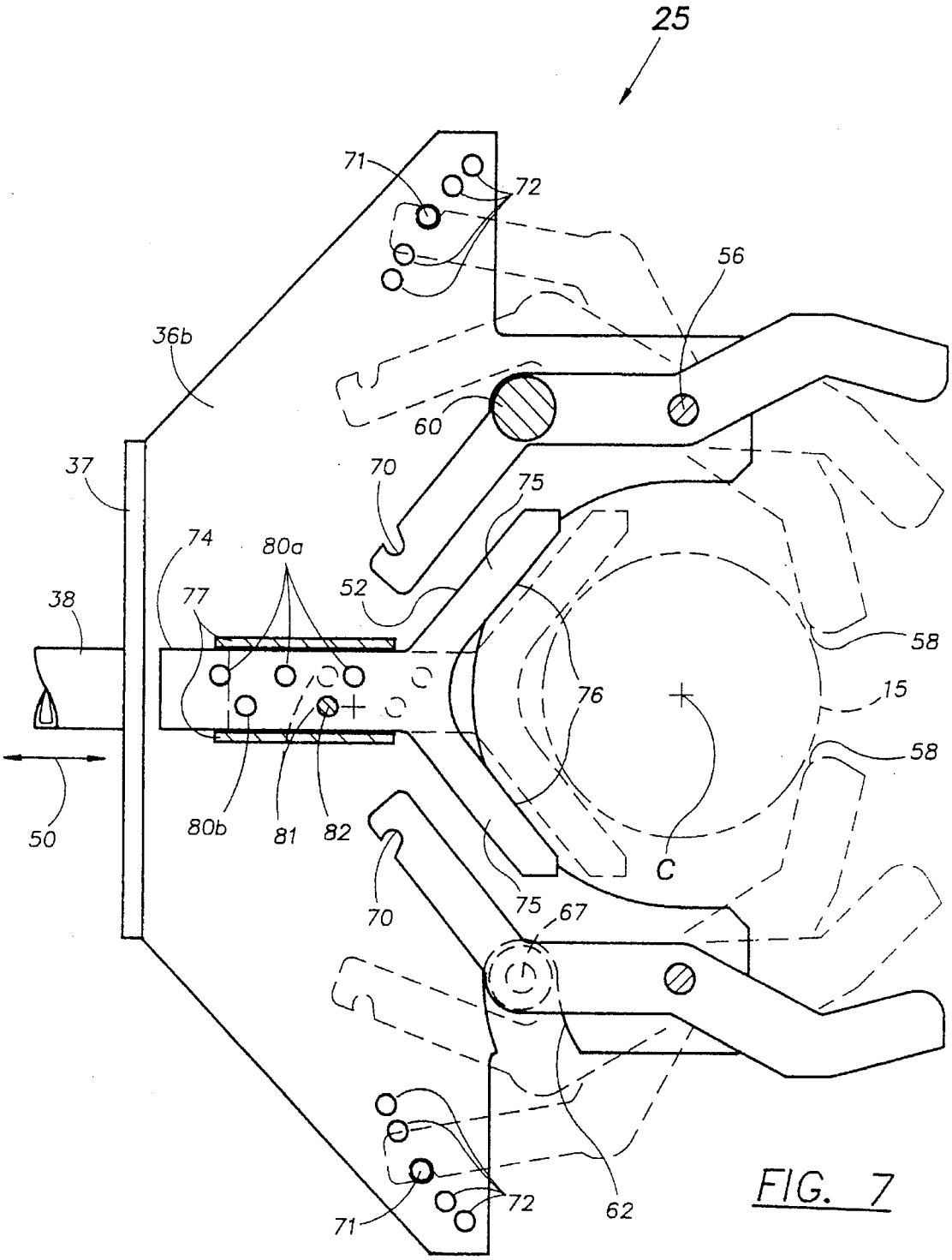
FIG. 7 is a cross-section view through the head assembly of FIGS. 4 to 6 as seen from the line 7—7 of FIG. 4.

The illustrated embodiment includes stop means which provide for the selected adjustment by determining the amount of pivot the cylinders can impart to arms 53,53 relative to the base of the head assembly. This in turn determines the final positioning of the pipe engaging surfaces 58,58 of the arms in relation to the pipe engaging surfaces of the then set guide 52 and its pipe engaging surfaces 76,76. Because the head has been initially centred on installation, the pipe engaging surfaces are thus properly located in relation to the centre of the pipe section C so that when the pipe section is held in the closed arms, the upper end of the pipe section aligns with the centre of the pipe section 14. In another embodiment of the invention what may be termed the stop means for determining the position of the pipe engaging surfaces 58,58 relative to the centre C so as to allow adjustment for different pipe sizes could be a non-adjustable or fixed stop. Such a fixed stop could be provided so that when the cylinder means are activated to close the arms 53,53, the closed position of the arms remains the same in relation to the head regardless of the pipe size. Instead, the previously described structure involving the shank 38, sleeve 46, and wing nut 38, which is provided to allow the initial adjustment of the head assembly as indicated by arrow 50 (FIG. 7), could be replaced with a more elaborate adjustable stop means, possibly similar to the means which allows the adjustment of the guide member 52. Such means could be calibrated so that a selection of movements in either direction would thus vary the position of the pipe engaging surface 58,58 relative to the centre C when the arms are fully closed. Thus, the closed position of the arms is adjusted to accommodate the particular size of pipe being used in the particular well operation by shifting the entire head assembly. After the adjustment of the head assembly as a whole, as represented by the arrow 50, adjustment would then be made for the fixed guide member 52 so that its pipe engaging surfaces provide points of contact at a radius from the centre C approximately equal to the diameter of the pipe. The calibration of adjustment means provided by the combination of the holes 80*a*, 80*b* and the holes 81 would have to be different than that for the first described embodiment in that the to and fro adjustment carried out in relation to the closed position for the arms 53,53 involves movement of the entire head assembly which would cause movement of the fixed guide member. Thus, the adjustment of the position of the fixed guide member 52 would be calibrated to simultaneously compensate for the head assembly movement as well as the repositioning for a different pipe size.

Other alternative embodiments within the spirit of the invention as defined by the claims will be apparent to those skilled in the art.

What I claim is:

1. A well pipe alignment apparatus for mounting on a derrick framework above a wellhead, said apparatus being engagable with an upper pipe section having a screw connection at the lower end thereof for threaded engagement with an upper end of a lower pipe section within a well bore for aligning said upper pipe section with said lower pipe section, said apparatus comprising, a supporting frame having an outer end for connection to the derrick framework, a head assembly carried at an inner end of said frame above said upper end of said lower pipe section, said head assembly having a base member and pipe engaging means carried by said base member for engaging and axially aligning said upper pipe section with the axis of the lower pipe section and allowing rotation of said upper pipe section within said head assembly, said pipe engaging means including a pipe guide member and movable arm means pivotable between an open position and a closed position, said pipe guide member and said arm means together having at least three pipe engaging surfaces for engaging a pipe section of a particular outer diameter at points about more than 180° of the pipe section circumference, said pipe guide member being mounted in said base member of said head assembly for movement toward and away from a central longitudinal axis of said upper pipe section, locking means for selectively affixing said pipe guide member in one of a plurality of positions depending on the size of the pipe section to be engaged, said arm means being connected by pivot means to said base member of said head assembly, cylinder means pivotally connected between said base member and said arm means for swinging said arm means on actuating thereof between the open and closed positions, stop means selectively adjustable between a plurality of positions for determining the position of the pipe engaging surface of the arm means in the closed position relative to the pipe engaging surface of the guide member for thereby selectively accommodating pipe sections of a plurality of circumferences.

2. The aligment apparatus of claim 1, wherein said arm means are connected by pivot means to said base member of said head assembly, and said power actuating means includes cylinder means pivotally connected between said base member and said arm means for swinging said arm means on actuating thereof between the open and closed positions.

3. The alignment apparatus of claim 2, wherein said arm means includes a pair of arm members, and said cylinder means includes a pair of cylinders, one each connected to one of said arm members, each arm member having a pipe engaging surface.

4. A well pipe alignment apparatus for mounting on a derrick framework above a wellhead, said apparatus being engagable with an upper pipe section having a screw connection at the lower end thereof for threaded engagement with an upper end of a lower pipe section within a well bore for aligning said upper pipe section with said lower pipe section, said apparatus comprising, a supporting frame having an outer end for connection to the derrick framework, a head assembly carried at an inner end of said frame above said upper end of said lower pipe section, said head assembly having a base member and pipe engaging means carried by said base member for engaging and axially aligning said upper pipe section with the axis of the lower pipe section and allowing rotation of said upper pipe section within said head assembly, said pipe engaging means including a pipe guide member and movable arm means pivotable between an open position and a position, said pipe guide member and said arm means together having at least three pipe engaging surfaces for engaging a pipe section of a particular outer diameter at points about more than 180° of the pipe section circumference, said pipe guide member being mounted in said base member of said head assembly for movement toward and away from a central longitudinal axis of said upper pipe section, locking means for selectively affixing said pipe guide member in one of a plurality of positions depending on the size of the pipe section to be engaged, said arm means being connected by pivot means to said base member of said head assembly, cylinder means pivotally connected between said base member and said arm means for swinging said arm means on actuating thereof between the open and closed positions, stop means selectively adjustable between a plurality of positions for determining the position of the pipe engaging surface of the arm means in the closed position relative to the pipe engaging surface of the guide member for thereby selectively accommodating pipe sections of a plurality of circumferences, said stop means including;

a stop member selectively positionable at a number of locations on said base member in the path of travel of said arm means during travel of said arm means toward said closed position to thereby limit the travel of the arm means and determine the closed position of the pipe engaging surfaces of said arm means, each of the selective positions of said stop member for determining the closed position of the arm means corresponding to one of the positions established by the locking means of said pipe guide member, whereby selection of the position of the stop member and a corresponding position of the locking means of the pipe guide member thereby establishes the positions of the pipe engaging surfaces of the arm means and of the pipe guide member at a substantially equal radius from the central longitudinal axis of the upper pipe section.

5. The alignment apparatus of claim 4, wherein said pipe guide member includes a shank portion, said base member defining a channel receiving said shank portion for sliding movement along a longitudinal axis of said channel toward and away from said longitudinal axis of said upper pipe section, said shank portion of said pipe guide member being provided with a plurality of openings along the length thereof, said base member being provided with at least one opening in communication with said channel and in alignment individually with said openings in said shank portion during movement of said pipe guide member through said plurality of positions, said locking means including pin means for receipt in aligned openings in said shank portion and said base member.

6. The alignment apparatus of claim 4, wherein said supporting frame includes pivotal connection means at said outer end, and further comprising second power actuated means for swinging said supporting frame to a position wherein said head assembly is retracted from the pipe alignment position, and further comprising control means for permitting manual activation of said power actuated means for moving said arm means selectively to the open position and the closed position and for swinging said supporting frame so as to thereby move the head assembly to a pipe alignment position or to a retracted position.

7. A well pipe alignment apparatus for mounting on a derrick framework above a wellhead, said apparatus being engagable with an upper pipe section having a screw connection at the lower end thereof for threaded engagement with an upper end of a lower pipe section within a well bore for aligning said upper pipe section with said lower pipe section, said apparatus comprising, a supporting frame having an outer end for connection to the derrick framework, a head assembly carried at an inner end of said frame above said upper end of said lower pipe section, said head assembly having a base member and pipe engaging means carried by said base member for engaging and axially aligning said upper pipe section with the axis of the lower pipe section and allowing rotation of said upper pipe section within said head assembly, said pipe engaging means including a pipe guide member and movable arm means pivotable between an open position and a closed position, said pipe guide member and said arm means together having at least three pipe engaging surfaces for engaging a pipe section of a particular outer diameter at points about more than 180° of the pipe section circumference, said pipe guide member being mounted in said base member of said head assembly for movement toward and away from a central longitudinal axis of said upper pipe section, locking means for selectively affixing said pipe guide member in one of a plurality of positions depending on the size of the pipe section to be engaged, said arm means being connected by pivot means to said base member of said head assembly, cylinder means pivotally connected between said base member and said arm means for swinging said arm means on actuating thereof between the open and closed positions, said arm means including a pair of arm members, said cylinder means including a pair of cylinders, one each connected to one of said arm members, each arm member having a pipe engaging surface, stop means selectively adjustable between a plurality of positions for determining the position of the pipe engaging surface of the arm means in the closed position relative to the pipe engaging surface of the guide member for thereby selectively accommodating pipe sections of a plurality of circumferences, said base member including a pair of parallel spaced plates, each arm member being mounted between said plates and including a tail portion integrally formed with a pipe engaging arm portion projecting from between said plates, said tail portion of each arm member defining a stop engaging surface, said pair of plates being provided with a series of aligned holes arrange on an arc struck on a radius about a pivot axis of the arm member and disposed on a path of pivot of the stop engaging surface, said stop means including a pin means insertable in a selected pair of said aligned holes in said pair of plates, said pin being thus positioned in an aligned pair of holes in said pair of plates to thereby determine the limit of swing of said tail portion and thus establish the closed position of the arm means.

8. The alignment apparatus of claim 7, wherein said pipe guide member includes a pair of leg portions affixed to said shank portion and thereby forming a Y-shaped configuration, said leg portions defining inside diverging surfaces providing the pipe engaging surfaces of said pipe guide member.

9. A well pipe alignment apparatus for mounting on a derrick framework above a wellhead, said apparatus being engagable with an upper pipe section having a screw connection at the lower end thereof for threaded engagement with an upper end of a lower pipe section within a well bore for aligning said upper pipe section with said lower pipe section, said apparatus comprising, a supporting frame having an outer end for connection to the derrick framework, a head assembly carried at an inner end of said frame above said upper end of said lower pipe section, said head assembly having a base member and pipe engaging means carried by said base member for aligning a central longitudinal axis of said upper pipe section with the axis of said lower pipe section and allowing rotation of said upper pipe section within said head assembly, mounting means between said head assembly and said supporting frame for initially aligning said head assembly in a to and fro direction along a first axis intersecting the central axis of said upper pipe section and in a side-to-side direction perpendicular to said first axis, said pipe engaging means including a pipe engaging guide member and arm means movable between an open position and a closed position, power actuating means for moving said arm means between said open and closed positions, said pipe guide member together with said arm means in said closed position having at least three pipe engaging surfaces for engaging a pipe section of a particular outer diameter at points about more than 180° of the pipe section circumference, a first adjustment means providing for movement of said pipe engaging guide member relative to said head assembly toward and away from a central longitudinal axis of said upper pipe section and including lock means for securing said pipe guide member in a position to accommodate a selected pipe section size, and a second adjustment means selectively movable to a position for determining the position of the pipe engaging surfaces of said arm means in said closed position in accordance with said selected pipe section size.

10. The alignment apparatus of claim 9, wherein said second adjustment means includes a stop member positionable in a number of locations on said base member in the path of travel of said arm means towards said closed position to thereby limit the travel of the arm means and thereby determine the closed position of the pipe engaging surface of said arm means.

11. A well pipe alignment apparatus for mounting on a derrick framework above a wellhead, said apparatus being engagable with an upper pipe section having a screw connection at the lower end thereof for threaded engagement with an upper end of a lower pipe section within a well bore for aligning said upper pipe section with said lower pipe section, said apparatus comprising:

a supporting frame having an outer end for connector to the derrick framework, a head assembly carried at an inner end of said frame above said upper end of said lower pipe section, said head assembly having a base member and pipe engaging means carried by said base member for aligning a central longitudial axis of said upper pipe section with the axis of said lower pipe section axle allowing rotation of said upper pipe section within said head assembly, said pipe engaging means including a pipe engaging guide member and arm means movable between an open position and a closed position, power actuating means for moving said arm means between said open and closed positions, said pipe guide member together with said arm means in said closed position having at least three pipe engaging surfaces for engaging a pipe section of a particular outer diameter at points about more than 180° of the pipe section circumference, a first adjustment means providing for movement of said pipe engaging guide member relative to said head assembly toward and away from a central longitudinal axis of said upper pipe section and including lock means for securing said pipe guide member in a position to accommodate a selected pipe section size, and a second adjustment means selectively movable to a position for determining the position of the pipe engaging surfaces of said arm means in said closed position in accordance with said selected pipe section size, said second adjustment means including mounting means between said head assembly and said supporting frame for positioning said head assembly at a number of selected positions in a to and fro direction along an axis intersecting the central axis of said upper pipe section, the selected position depending on the size of the pipe section to be engaged, said mounting means between said head assembly and said supporting frame further including set-up means for initially aligning said head assembly in a side-to-side direction perpendicular to said axis intersecting the central axis of the upper pipe section.

12. The alignment apparatus of claim 11, wherein said arm means includes a pair of arm members connected by pivot means to said base member of said head assembly, each arm member having a pipe engaging surface, and wherein said power actuating means includes a pair of power cylinders pivotally connected between said base member and said arm means, one each being connected to one of said arm members for swinging said arm members on actuating thereof between the open and closed positions of said members.

13. The alignment apparatus of claim 11, wherein said pipe engaging guide member is mounted in said base member of said head assembly for movement relative to said base member toward and away from the central longitudinal axis of said upper pipe section, said pipe engaging guide member including a shank portion, said base member of said head assembly defining a channel receiving said shank portion for sliding movement along a longitudinal axis of said channel, and including locking means for affixing said pipe engaging guide member in one of a plurality of positions depending on the size of the pipe section to be engaged.

14. The alignment apparatus of claim 13, wherein said shank portion of said pipe guide member is provided with a plurality of openings along the length thereof, said base member of said head assembly having at least one opening in communication with said channel and in alignment individually with said openings in said shank portion during movement of said pipe engaging guide member through said plurality of positions, and wherein said locking means includes pin means for receipt in aligned openings in said shank portion and said base member.

15. The alignment apparatus of claim 13, wherein said pipe engaging guide member includes a pair of leg portions affixed to said shank portion and thus forming a Y-shaped configuration, said leg portions defining inside diverging surfaces providing the pipe engaging surfaces of said pipe guide member.

16. A well pipe alignment apparatus for mounting on a derrick framework above a wellhead, said apparatus being engagable with an upper pipe section having a screw connection at the lower end thereof for threaded engagement with an upper end of a lower pipe section within a well bore for aligning said upper pipe section with said lower pipe section, said apparatus comprising, a supporting frame having an outer end for connection to the derrick framework, a head assembly carried at an inner end of said frame above said upper end of said lower pipe section, said head assembly having a base member and pipe engaging means carried by said base member for aligning a central longitudinal axis of said upper pipe section with the axis of said lower pipe section and allowing rotation of said upper pipe section within said head assembly, said pipe engaging means including a pipe engaging guide member and arm means movable between an open position and a closed position, said arm means being connected by pivot means to said base member of said head assembly, power actuating means including cylinder means pivotally connected between said base member and said arm means for swinging said arm means on actuating thereof between the open and closed position, said pipe guide member together with said arm means in said closed position having at least three pipe engaging surfaces for engaging a pipe section of a particular outer diameter at points about more than 180° of the pipe section circumference, said pipe engaging guide member being mounted in said base member of said head assembly for movement toward and away from the central longitudinal axis of said upper pipe section, and including locking means for affixing said pipe engaging guide member in one of a plurality of positions depending on the size of the pipe section to be engaged, adjustment means selectively movable to a position for determining the position of the pipe engaging surfaces of said arm means in said closed position in accordance with said selected pipe section size, said adjustment means including a stop member selectively positionable at a number of locations on said base member in the path of travel of said arm means during travel of said arm means toward said closed position to thereby limit the travel of the arm means and determine the closed position of the pipe engaging surfaces of said arm means.

17. A well pipe alignment apparatus for mounting on a derrick framework above a wellhead, said apparatus being engagable with an upper pipe section having a screw connection at the lower end thereof for threaded engagement with an upper end of a lower pipe section within a well bore for aligning said upper pipe section with said lower pipe section, said apparatus comprising:

a supporting frame having an outer end for connection to the derrick framework, a head assembly carried at an inner end of said frame above said upper end of said lower pipe section, said head assembly having a base member and pipe engaging means carried by said base member for aligning a central longitudinal axis of said upper pipe section with the axis of said lower pipe section and allowing rotation of said upper pipe section within said head assembly, said pipe engaging means including a pipe engaging guide member and arm means movable between an open position and a closed position, said arm means including a pair of arm members, cylinder means for moving said arm members between said open and closed positions said cylinder means including a pair of cylinders one each connected to one of said arm members, said pipe engaging guide member together with said arm means in said closed position having at least three pipe engaging surfaces for engaging a pipe section of a particular outer diameter at points about more than 180° of the pipe section circumference, each arm member having a pipe engaging surface, a first adjustment means providing for movement of said pipe engaging guide member relative to said head assembly toward and away from a central longitudinal axis of said upper pipe section and including lock means for securing said pipe guide member in a position to accommodate a selected pipe section size, and a second adjustment means selectively movable to a position for determining the position of the pipe engaging surfaces of said arm means in said closed position in accordance with said selected pipe section size, each arm member having a stop engaging surface, said second adjustment means including a pin means, said base member comprising a pair of parallel spaced plates, each arm member being mounted between said plates and including a tail portion integrally formed with a pipe engaging arm portion projecting from between said plates, said tail portion defining said stop engaging surface, said pair of plates being provided with a pair of series of aligned holes, each series being arranged an arc struck on a radius about a pivot axis of one of the arm members and being disposed on a path of pivot of the stop engaging surface of its respective arm member, said pin means being received in an aligned pair of holes in said pair of plates to thereby establish the limit of swing of said tail portion and thus establish the closed position of the arm member.

18. A well pipe alignment apparatus for mounting on a derrick framework above a wellhead, said apparatus being engagable with an upper pipe section having a screw connection the lower end thereof for threaded engagement with an upper end of a lower pipe section within a well bore for aligning said upper pipe section with said lower pipe section, said apparatus comprising:

a supporting frame having an outer end for connection to the derrick framework, a head assembly carried at an inner end of said frame above said upper end of said lower pipe section, said head assembly having a base member and pipe engaging means carried by said base member for aligning a central longitudinal axis of said upper pipe section with the axis of said lower pipe section and allowing rotation of said upper pipe section within said head assembly, said pipe engaging means including a pipe engaging guide member and arm means movable between an open position and a closed position, said pipe engaging guide member together with said arm means in said closed position having at least three pipe engaging surfaces for engaging a pipe section of a particular outer diameter at points about more than 180° of the pipe section circumference, a first adjustment means providing for movement of said pipe engaging guide member relative to said head assembly toward and away from the central longitudinal axis of said upper pipe section and including lock means for securing said pipe guide member in a position to accommodate a selected pipe section size, and a second adjustment means selectively movable to a position for determining the position of the pipe engaging surfaces of said arm means in said closed position in accordance with said selected pipe section size, said pipe engaging guide member being mounted in said base member of said head assembly for movement toward and away from the central longitudinal axis of said upper pipe section, locking means for affixing said pipe guide member in one of a plurality of positions depending on the size of the pipe section to be engaged, said arm means being connected by pivot means to said base member of said head assembly, power actuating means including cylinder means pivotally connected between said base member and said arm means for swinging said arm means on actuating thereof between the open and closed positions, said second adjustment means including a stop member selectively positionable at a number of locations on said base member in the path of travel of said arm means, during travel of said arm means toward said closed position to thereby limit the travel of the arm means and determine the closed position of the pipe engaging surfaces of said arm means, each of the locations of said stop member for determining the closed position of the arm means corresponding to one of the positions established by the locking means of the pipe engaging guide member, whereby selection of a position of the stop member and a corresponding position of the locking means of the pipe engaging guide member thereby establishes the positions of the pipe engaging surfaces of the arm means and of the pipe engaging guide member at a substantially equal radius from the central longitudinal axis of the upper pipe section.

* * * * *